US011559464B2

(12) United States Patent
McDowell

(10) Patent No.: US 11,559,464 B2
(45) Date of Patent: Jan. 24, 2023

(54) SEALER-LESS PLASMA BOTTLE AND TOP FOR SAME

(71) Applicant: Haemonetics Corporation, Boston, MA (US)

(72) Inventor: Christopher S. McDowell, Murray, UT (US)

(73) Assignee: Haemonetics Corporation, Boston, MA (US)

( * ) Notice: Subject to any disclaimer, the term of this patent is extended or adjusted under 35 U.S.C. 154(b) by 932 days.

(21) Appl. No.: 16/099,917

(22) PCT Filed: May 16, 2017

(86) PCT No.: PCT/US2017/032824
§ 371 (c)(1),
(2) Date: Nov. 8, 2018

(87) PCT Pub. No.: WO2017/200992
PCT Pub. Date: Nov. 23, 2017

(65) Prior Publication Data

US 2019/0151200 A1 May 23, 2019

Related U.S. Application Data

(60) Provisional application No. 62/337,031, filed on May 16, 2016.

(51) Int. Cl.
*A61J 1/12* (2006.01)
*A61J 1/14* (2006.01)
(Continued)

(52) U.S. Cl.
CPC ..... *A61J 1/1406* (2013.01); *A61J 1/03* (2013.01); *A61J 1/05* (2013.01); *A61J 1/10* (2013.01);
(Continued)

(58) Field of Classification Search
CPC ..... A61J 1/03; A61J 1/05; A61J 1/10; A61J 1/12; A61J 1/14; A61J 1/1406;
(Continued)

(56) References Cited

U.S. PATENT DOCUMENTS 2,447,691 A 8/1948 Evans
3,952,902 A 4/1976 Prouty et al.
(Continued)

FOREIGN PATENT DOCUMENTS

CN 2199152 Y 5/1995
CN 2665055 Y 12/2004
(Continued)

OTHER PUBLICATIONS

International Search Report and Written Opinion for Application No. PCT/US2017/032824, dated Aug. 1, 2017, 7 pages.
(Continued)

*Primary Examiner* — Kai H Weng
(74) *Attorney, Agent, or Firm* — McCarter & English, LLP; Jonathan C. Lovely

(57) ABSTRACT

A top for a plasma storage container includes a top body that defines the structure of the top and seals an opening of the plasma storage container. The top also includes a first opening and a vent opening extending through the top body. A septum is located at least partially within the first opening and includes an aperture therethrough. The septum allows a blunt cannula to pass through the aperture to access the interior of the plasma storage container. The top also includes a hydrophobic membrane located on underside of the top body. The membrane covers the vent opening and allows air to vent through the vent opening during plasma collection.

41 Claims, 5 Drawing Sheets

(51) Int. Cl.
*A61J 1/05* (2006.01)
*A61J 1/10* (2006.01)
*A61J 1/20* (2006.01)
*A61J 1/03* (2006.01)

(52) U.S. Cl.
CPC . *A61J 1/12* (2013.01); *A61J 1/14* (2013.01); *A61J 1/1431* (2015.05); *A61J 1/20* (2013.01); *A61J 1/2075* (2015.05); *A61J 1/2006* (2015.05)

(58) Field of Classification Search
CPC ..... A61J 1/1412; A61J 1/1431; A61J 1/20; A61J 1/2006; A61J 1/2075; A61M 1/0001; A61M 1/0003; A61M 1/0017; A61M 1/005
See application file for complete search history.

(56) References Cited

U.S. PATENT DOCUMENTS

| | | | | |
|---|---|---|---|---|
| 4,508,236 | A | 4/1985 | Keilman et al. | |
| 4,568,345 | A | 2/1986 | Keilman et al. | |
| 4,744,785 | A | 5/1988 | Rosenthal et al. | |
| 5,045,077 | A * | 9/1991 | Blake, III | A61M 1/0001 604/321 |
| 5,132,026 | A | 7/1992 | Baluyot et al. | |
| 5,658,260 | A * | 8/1997 | Desecki | A61J 1/2089 604/239 |
| 6,012,596 | A * | 1/2000 | Oglesbee | A61J 1/1406 215/261 |
| 6,056,731 | A * | 5/2000 | Koetke | A61M 1/604 604/323 |
| 6,090,091 | A | 7/2000 | Fowles et al. | |
| 6,168,037 | B1 | 1/2001 | Grimard | |
| 6,171,261 | B1 | 1/2001 | Niermann et al. | |
| 6,209,738 | B1 | 4/2001 | Jansen et al. | |
| 6,221,041 | B1 | 4/2001 | Russo | |
| 6,261,266 | B1 | 7/2001 | Jepson et al. | |
| 6,391,014 | B1 | 5/2002 | Silverman | |
| 6,426,049 | B1 | 7/2002 | Rosen et al. | |
| 6,475,194 | B2 | 11/2002 | Domici, Jr. et al. | |
| 6,616,632 | B2 | 9/2003 | Sharp et al. | |
| 6,648,859 | B2 | 11/2003 | Bitdinger et al. | |
| 6,702,779 | B2 | 3/2004 | Connelly et al. | |
| 6,715,520 | B2 | 4/2004 | Andreasson et al. | |
| 6,796,957 | B2 | 9/2004 | Carpenter et al. | |
| 6,979,316 | B1 | 12/2005 | Rubin et al. | |
| 7,033,339 | B1 | 4/2006 | Lynn | |
| 7,063,673 | B2 | 6/2006 | Marsden | |
| 7,985,216 | B2 | 7/2011 | Daily et al. | |
| 8,262,641 | B2 | 9/2012 | Vedrine et al. | |
| 8,303,914 | B2 | 11/2012 | Zurcher | |
| 8,348,904 | B2 | 1/2013 | Petersen | |
| 8,465,460 | B2 | 6/2013 | Yodat et al. | |
| 8,523,814 | B2 | 9/2013 | Finke | |
| 8,869,635 | B2 | 10/2014 | Daniel et al. | |
| 8,900,212 | B2 | 12/2014 | Kubo | |
| 8,905,994 | B1 | 12/2014 | Lev et al. | |
| 8,915,890 | B2 | 12/2014 | Lum et al. | |
| 8,932,264 | B2 | 1/2015 | DeSalvo | |
| 8,961,489 | B2 | 2/2015 | Schwarz et al. | |
| 8,986,264 | B2 | 3/2015 | Kimmel et al. | |
| 9,198,831 | B2 | 12/2015 | Rogers | |
| 9,295,788 | B2 | 3/2016 | Green | |
| 9,381,137 | B2 | 7/2016 | Garfield et al. | |
| 9,414,990 | B2 | 8/2016 | Ivosevic et al. | |
| 9,554,967 | B2 | 1/2017 | Moia et al. | |
| 9,597,260 | B2 | 3/2017 | Ivosevic et al. | |
| 9,642,774 | B2 | 5/2017 | Sattig | |
| 9,668,939 | B2 | 6/2017 | Carrel et al. | |
| 9,789,027 | B2 | 10/2017 | Sund et al. | |
| 9,895,288 | B2 | 2/2018 | Augustini et al. | |
| 9,913,627 | B2 | 3/2018 | Ellis et al. | |
| 10,085,680 | B2 | 10/2018 | Crawford et al. | |
| 2004/0199126 | A1 | 10/2004 | Harding et al. | |
| 2007/0244456 | A1 | 10/2007 | Fangrow | |
| 2008/0121050 | A1 | 5/2008 | Sakai et al. | |
| 2010/0059474 | A1 | 3/2010 | Brandenburger et al. | |
| 2010/0152674 | A1 | 6/2010 | Kavazov et al. | |
| 2011/0118676 | A1 | 5/2011 | Kropczynski, Jr. et al. | |
| 2011/0284413 | A1 | 11/2011 | Meise | |
| 2012/0136333 | A1* | 5/2012 | Hatalla | B65D 51/002 604/500 |
| 2013/0079744 | A1 | 3/2013 | Okiyama et al. | |
| 2014/0259724 | A1 | 9/2014 | McCarthy et al. | |
| 2014/0324011 | A1 | 10/2014 | Rettinghaus et al. | |
| 2017/0224860 | A1* | 8/2017 | Muller | C12Q 1/22 |
| 2019/0046406 | A1 | 2/2019 | McDowell et al. | |
| 2020/0253827 | A1 | 8/2020 | Zhang et al. | |

FOREIGN PATENT DOCUMENTS

| | | | |
|---|---|---|---|
| CN | 1878703 | A | 12/2006 |
| CN | 101600411 | A | 12/2009 |
| CN | 103459036 | A | 12/2013 |
| CN | 103818646 | A | 5/2014 |
| CN | 204582131 | U | 8/2015 |
| CN | 105232331 | A | 1/2016 |
| CN | 105879196 | A | 8/2016 |
| CN | 205948043 | U | 2/2017 |
| DE | 4317316 | A1 | 12/1994 |
| DE | 20010825 | U1 | 11/2000 |
| DE | 202009001068 | U1 | 4/2009 |
| EP | 0379047 | A1 | 7/1990 |
| EP | 1525918 | A2 | 4/2005 |
| EP | 1825878 | A1 | 8/2007 |
| JP | 53-19276 | | 2/1978 |
| JP | 3-11648 | | 2/1991 |
| JP | 5-77039 | | 10/1993 |
| JP | 2008-237781 | A | 10/2008 |
| JP | 2009-125162 | A | 6/2009 |
| WO | 2005/004783 | A2 | 1/2005 |
| WO | 2005/037659 | A2 | 4/2005 |
| WO | 2015/106191 | A1 | 7/2015 |
| WO | 2016/058662 | A1 | 4/2016 |
| WO | 2017/200992 | A1 | 11/2017 |

OTHER PUBLICATIONS

International Search Report and Written Opinion for Application No. PCT/US2019/033518, dated Aug. 8, 2019, 21 pages.
Supplementary European Search Report for Application No. 17799981.0, dated Nov. 6, 2019, 8 pages.

* cited by examiner

SEALER-LESS PLASMA BOTTLE AND TOP FOR SAME

CROSS-REFERENCE TO RELATED APPLICATIONS

This patent application is a 35 U.S.C. § 371 national stage application of International Application No. PCT/US2017/032824, filed May 16, 2017, which claims priority from United States Provisional Patent Application No. 62/337,031, filed May 16, 2016, entitled "Sealer-Less Plasma Bottle and Top for Same," and naming Christopher S. McDowell as inventor. The disclosure of each of the foregoing applications is incorporated herein, in its entirety by reference.

This patent application is related to United States Provisional Patent Application No. 62/674,913, filed May 22, 2018, entitled "Sealer-Less Plasma Bottle and Top for Same," and naming Christopher S. McDowell as inventor.

This patent application is also related to United States Patent Application No. 16/161,482, filed Oct. 16, 2018, entitled "Sealer-Less Plasma Bottle and Top for Same," and naming Christopher S. McDowell as inventor.

TECHNICAL FIELD

The present invention relates to blood component storage containers, and more particularly plasma storage containers.

BACKGROUND ART

Blood plasma is a straw-colored liquid component of whole blood, in which blood cells, such as red blood cells and white blood cells, and other components of the whole blood are normally suspended. Whole blood is made up of about 55%, by volume, plasma. Plasma plays important roles in a body's circulatory system, including transporting blood cells, conducting heat and carrying waste products. Pure plasma contains clotting factors, which increase the rate at which blood clots, making it useful in surgery and in the treatment of hemophilia. Banked whole blood is sometimes used to replace blood lost by patients during surgery or as a result of traumatic injuries. However, if banked whole blood that is compatible with the patient's blood type is not available, plasma may sometimes be used to replace some of the lost blood. Furthermore, plasma may be frozen and stored for relatively long periods of time until it is needed.

To collect plasma, whole blood may be collected from a donor, and the plasma may be separated from the other components of the donated whole blood later, such as in a laboratory. However, in other cases, the plasma is separated from the other components of the whole blood at the donation site, and the other components are returned to the circulation system of the donor. For example, apheresis is a medical technology in which the blood of a donor or patient is passed through an apparatus, such as a centrifuge, that separates out one particular constituent and returns the remainder to the donor or patient. Plasmapheresis is a medical therapy that involves separating blood plasma from whole blood.

Collected plasma is typically stored in plastic bottles. A typical plasma bottle includes two ports, one for introducing plasma into the bottle, and the other for venting air out of the bottle. Each of the ports typically extends from a surface of the plasma bottle (e.g., the top of the plasma bottle) and may have tubing connected to it. After plasma has been collected in the bottle, the tubing is cut off using radiofrequency sealing tongs, leaving short (typically about 1½ inch long) sealed tubing stubs attached to the ports extending from the plasma bottle. These stubs typically project from the bottle neck and may pose problems during transport and storage. For example, when the plasma is frozen, the plastic of the stubs and/or ports becomes brittle and may break, thereby violating the requirement to keep the plasma in a sealed container.

SUMMARY OF THE EMBODIMENTS

In a first embodiment of the invention there is provided a top for a plasma storage container. The top includes a top body that defines the structure of the top and seals an opening of the plasma storage container. The top may also include a first opening and a vent opening extending through the top body. A septum may be located at least partially within the first opening, and may include an aperture through it. The septum may allow a blunt cannula to pass through the aperture to access the interior of the plasma storage container. The top may also include a hydrophobic membrane located on underside of the top body. The membrane covers the vent opening and may allow air to move through the vent opening during filling of the plasma storage container while preventing ingress of undesirable microorganisms.

In some embodiments, the top may also include a skirt that extends downward from the underside of the top body around the first opening. The septum may be located and secured (e.g., via a swage connection) within the skirt. Alternatively, the septum may be overmolded with the skirt. The skirt and/or the swage connection may apply a compressive retaining force on the aperture. The aperture may be closed when the blunt cannula is not connected, and the first opening may be larger than the vent opening. Additionally or alternatively, the septum may allow a sample collection container holder to pass through the aperture to access the interior of the plasma collection container. For example, the sample collection container holder may be a vacutainer holder. The blunt cannula may be part of a tubing set connected to a blood processing device.

The top body may also include at least one flow channel on the underside of the top body. The at least one flow channel may be in fluid communication with the vent opening to allow airflow in and out of the plasma storage container via the vent opening. The surface area of the hydrophobic membrane may be larger than a cross-sectional area of the vent opening, and/or the hydrophobic membrane may be sealed and/or ultrasonically welded to an energy director on the underside of the top body. The top may include a retaining element (e.g., a clip) located on a top surface of the top body. The retainer may hold the blunt cannula in place during filling of the plasma storage container.

In accordance with additional embodiments, a plasma storage container includes a container body that defines the structure of the plasma storage container and defines an interior. The container includes a top configured to seal an opening of the plasma storage container. The top may include a first opening and a vent opening extending through the container top. A septum may be located at least partially within the first opening and may include a pre-pierced aperture therethrough. The septum/aperture allow a blunt cannula to pass through the aperture to access the interior of the plasma storage container. The container also includes a hydrophobic membrane located on underside of the container top. The membrane covers the vent opening and allows air to pass through the vent opening during plasma collection. The first opening may be larger than the vent opening.

In some embodiments, the plasma storage container may include a skirt that extends from the underside of the container top around the first opening. The septum may be located and secured within the skirt, for example, via a swage connection. Additionally or alternatively, the septum may be overmolded within the skirt. The skirt and/or the swage connection may apply a radially inward force on the aperture that biases the aperture closed. The aperture may be closed when the blunt cannula is not connected.

The container top may include at least one flow channel on an underside of the container top. The flow channel(s) may be in fluid communication with the vent opening to allow airflow in and out of the plasma storage container via the vent opening. The surface area of the hydrophobic membrane may be larger than a cross-sectional area of the vent opening. Additionally or alternatively, the hydrophobic membrane may be ultrasonically welded to the underside of the container top and/or may be sealed to the underside of the container top.

In further embodiments, the plasma storage container may include a retainer located on a top surface of the container top. The retainer may hold the blunt cannula in place during filling of the plasma storage container, and/or may be a clip. In other embodiments, the septum may allow a sample collection container holder (e.g., a vacutainer holder) to pass through the aperture to access the interior of the plasma collection container. The blunt cannula may be part of a tubing set connected to a blood processing device.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1:
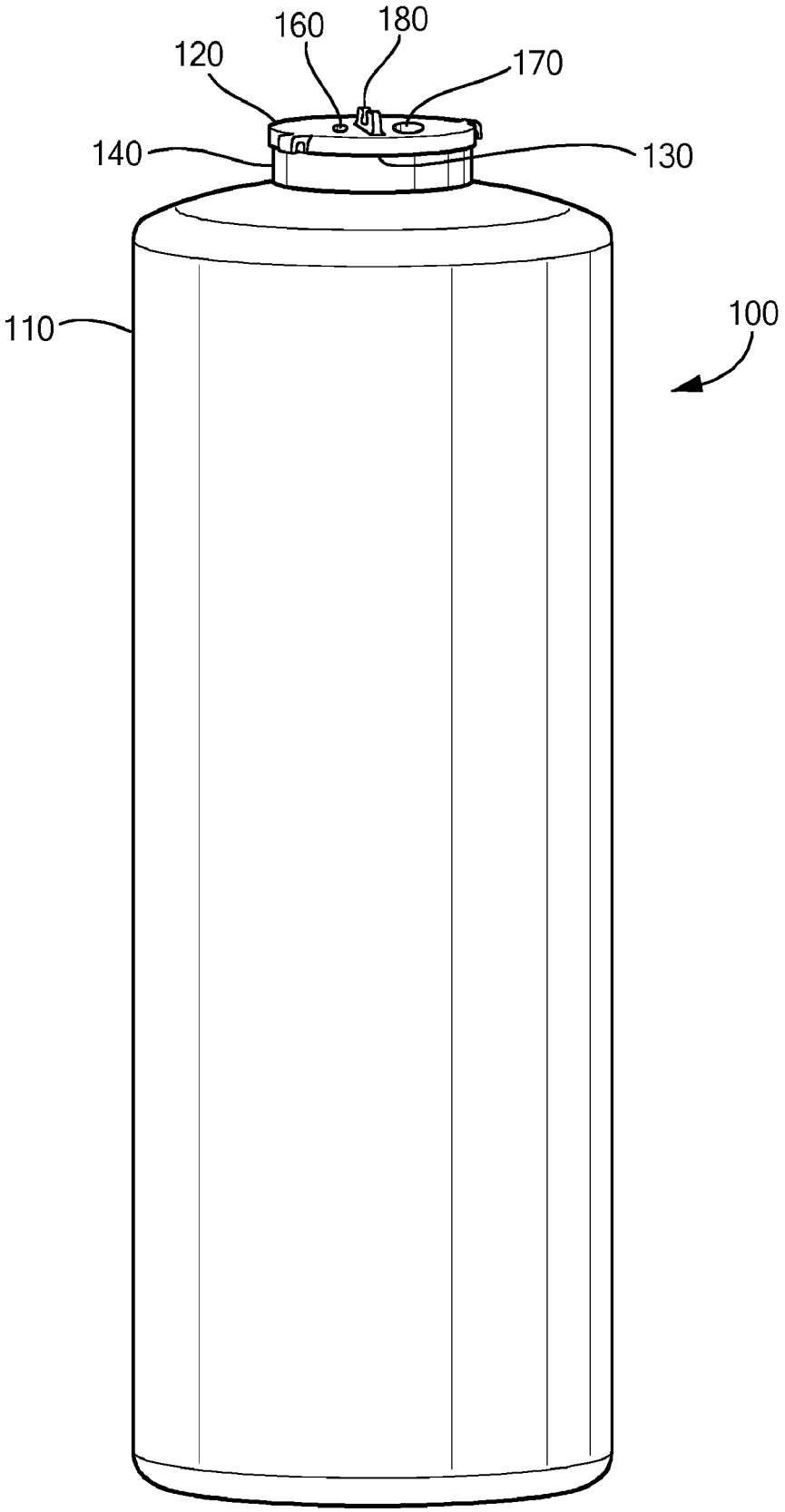
FIG. 1 schematically shows a perspective view of a plasma storage container, in accordance with embodiments of the present invention.

FIG. 1 is a perspective view of a blood plasma container 100, according to an embodiment of the present invention. The plasma container 100 may have a body portion 110 and a top 120 that closes an opening 130 (e.g., an open end in the body portion 110 at the proximal end 140 of the plasma container 100). As discussed in greater detail below, plasma may be collected within the plasma container 100 and sampled through the top 120. The body portion 110 defines an interior volume 150 (e.g., an interior) in which the collected plasma can be stored.

Figure 2:
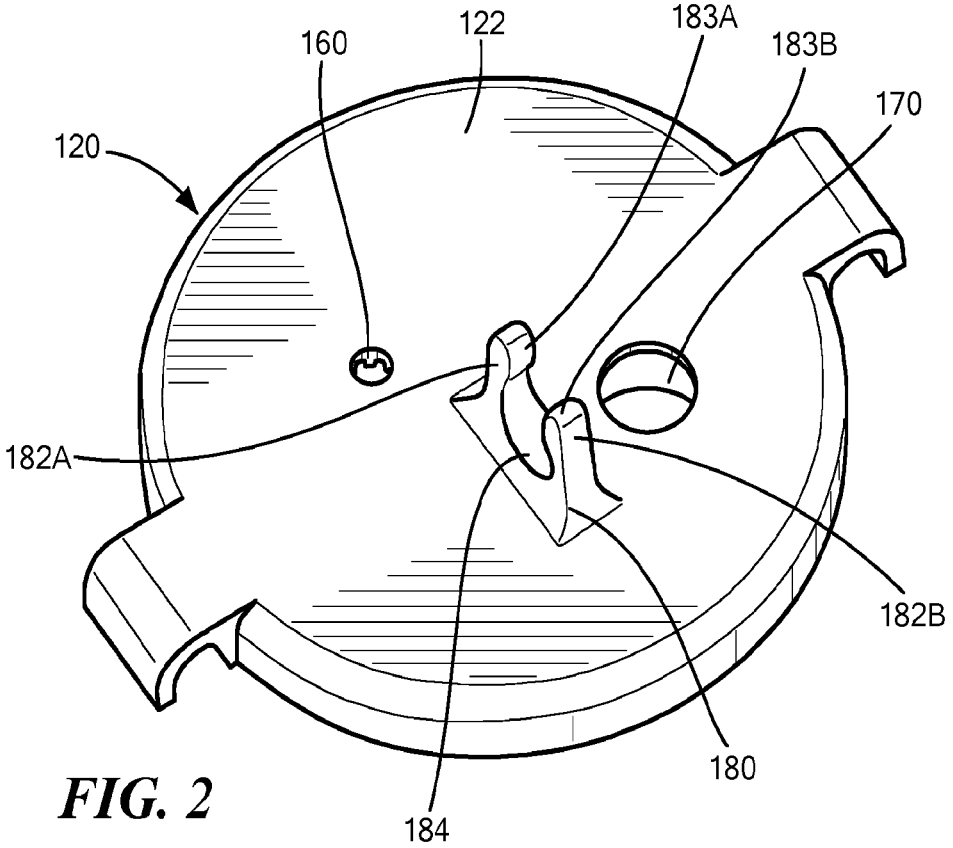
FIG. 2 schematically shows a top perspective view of a top, without a septum and hydrophobic membrane installed, for the plasma storage container shown in FIG. 1, in accordance with embodiments of the present invention.
Figure 3:
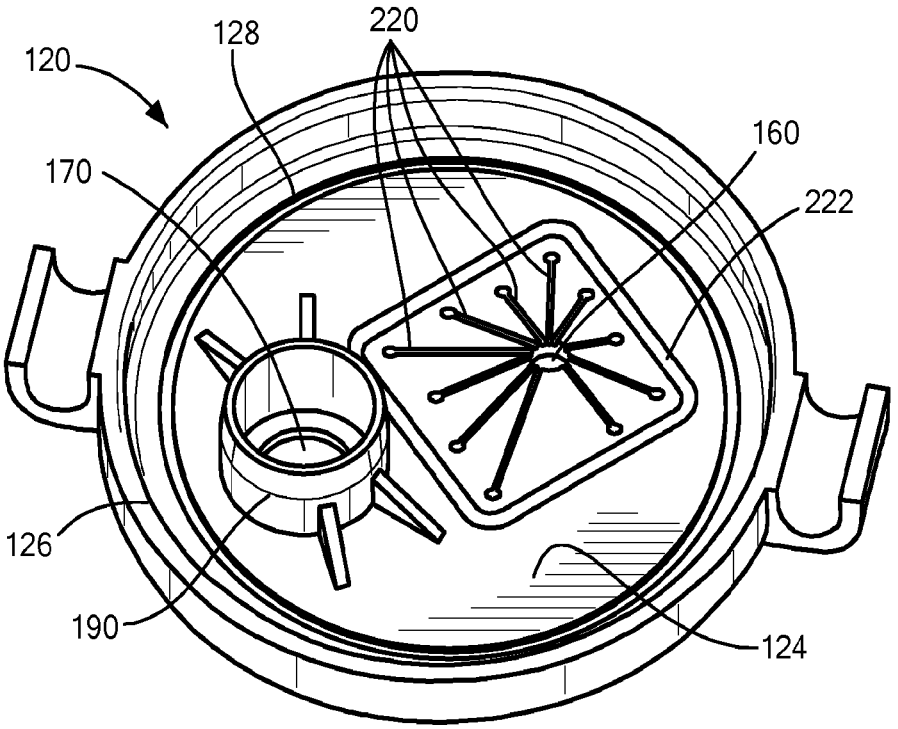
FIG. 3 schematically shows a bottom perspective view of a top, without a septum and hydrophobic membrane installed, for the plasma storage container shown in FIG. 1, in accordance with embodiments of the present invention.

As shown in FIGS. 2 and 3, the top 120 includes a vent hole 160 through which air may pass bidirectionally during plasma collection 100, and an inlet hole 170 through which the plasma may be transferred into the plasma container 100. The size of the vent hole 160 and the inlet hole 170 may vary depending on the application, but, in some embodiments, the inlet hole 170 may be substantially larger the vent hole 160. Additionally, the top 120 may include a retainer 180 extending from a top surface 122 of the top. As discussed in greater detail below, the retainer 180 may be used to secure a blunt cannula (which, in turn, is used to transfer plasma into the container 100) to the top 120 of the plasma container 100 while plasma is being collected within the container 100. The retainer 180 may be any number of components capable of securing the blunt cannula. For example, the retainer 180 may be clip with two proximally extending protrusions 182A/B that define a space 184 between them in which the cannula may reside. In such embodiments, the user may push the cannula into the retainer/clip 180 until it snaps/clicks into the space 184. To hold the cannula in place within the clip 180, the protrusions 182A/B may include inward projections 183A/B that extend over the cannula when it is located within the space 184.

Figure 4:
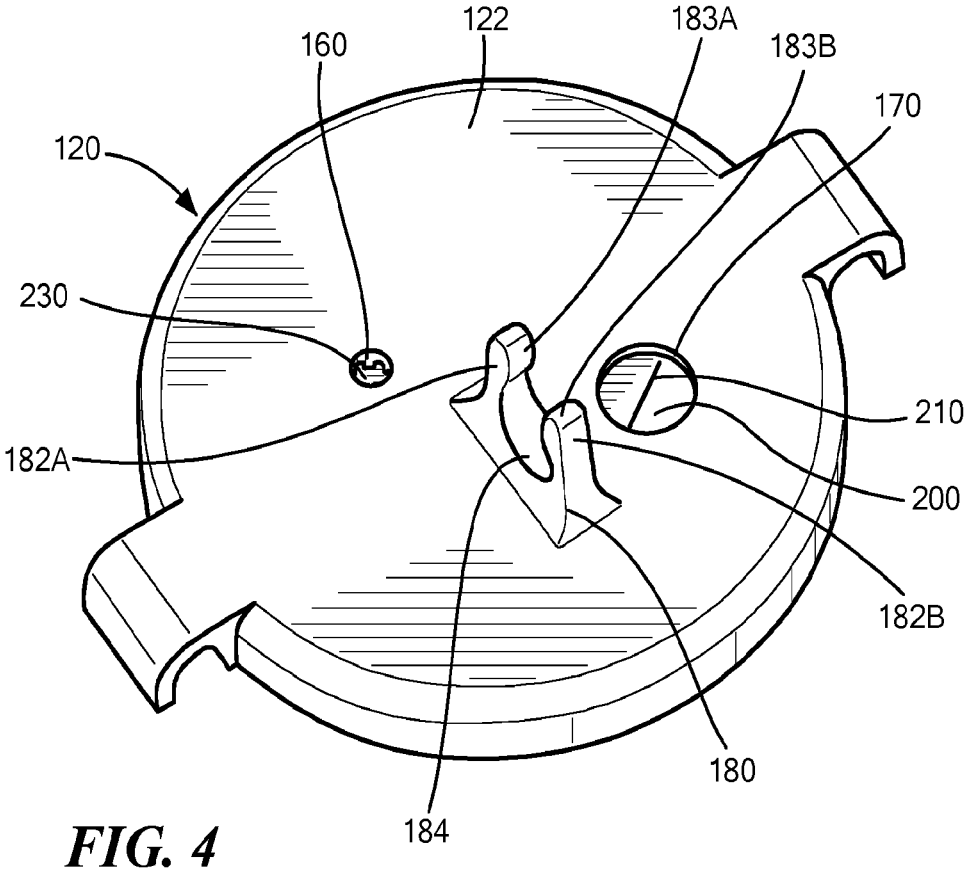
FIG. 4 schematically shows a top perspective view of a top, with a septum and hydrophobic membrane installed, for the plasma storage container shown in FIG. 1, in accordance with embodiments of the present invention.
Figure 5:
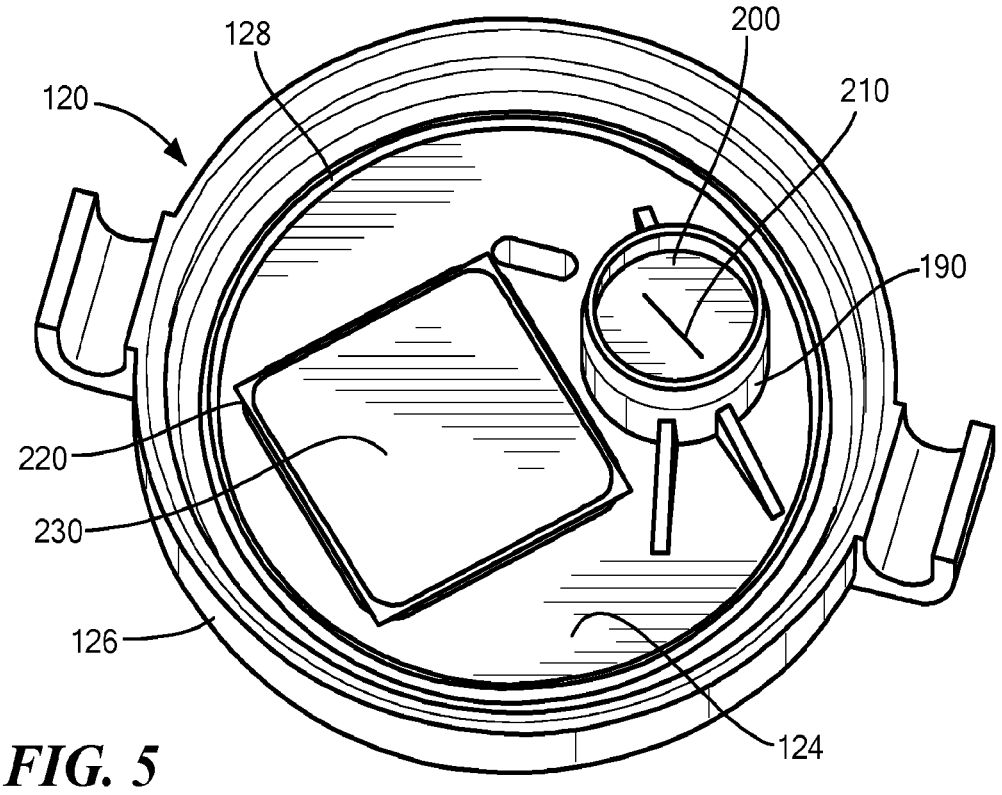
FIG. 5 schematically shows a bottom perspective view of a top, with a septum and hydrophobic membrane installed, for the plasma storage container shown in FIG. 1, in accordance with embodiments of the present invention.

On the underside 124, the top 120 may include a skirt 190 that extends distally from the top 120 (e.g., downward from the top 120) and around the inlet opening 170. To help maintain the sterility of the container 100 and keep the inlet opening 170 closed when the container is not being filled with plasma (e.g., before and after filling), the top 120 may include a septum 200 located and secured within the skirt 190. As best shown in FIGS. 4 and 5, the septum 200 may have an aperture 210 extending through the body of the septum 200. The aperture 210 may be normally closed (e.g., closed when in its natural state and not subject to any external pressures) and/or the aperture 210 may be held closed by a radially compressive force applied to the septum 200 by the skirt 190. For example, the septum 200 may be swaged into the skirt 190. As is known in the art, when the septum 200 is swaged within the skirt 190, a portion of the skirt 190 (e.g., the bottom of the skirt) may be compressed into the septum 200. This creates a compressive force that keeps the septum 200 in the skirt 190. Additionally or alternatively, the outer diameter of the septum 200 may be larger than the inner diameter of the skirt 190 and the septum 200 may be press-fit into the skirt 190. This press-fit will create the radially inward force that keeps the aperture 210 closed.

It should be noted that, although the aperture 210 is shown as a slit within FIGS. 4 and 5, other aperture configurations may be used. For example, the aperture 210 may consist of two slits formed into a cross shape. Alternatively, the aperture 210 can have more than two slits in the shape of a star or asterisk. It is important to note that the aperture 210 (e.g., the one or more slits) may be formed, for example, using traditional cutting means (e.g., razor blade, knife, etc.), piercing with a needle, or ultrasonic cutting methods. Additionally or alternatively, the aperture 210 could also be formed in-mold during or after the injection molding process.

Also on the underside 124, the top 120 may include a hydrophobic membrane 230 located under the vent hole 160 such that the hydrophobic membrane 230 may provide a sterile barrier for the vent hole 160. During filling of the plasma container 100, the hydrophobic membrane 230 will allow air to pass through the membrane 230 and the vent hole 160 to prevent atmospheric pressure differentials from building up in the container 100. To help with air flow, the top may also include a number of channels 220 within the surface under the hydrophobic membrane 230. The channels 220 can extend to the edge of the vent hole 160 and allow air pass through the membrane 230, for example, even if the membrane 230 is pushed against the underside 124 of the top 120 (e.g., during high-air-flow-rate periods).

The hydrophobic membrane 230 may be ultrasonically welded to the top 120 (or otherwise sealed to the top 120) to prevent air from leaking past the hydrophobic membrane 230. To that end, the top 120 may include an energy director 222 for use during the ultrasonic welding process to ensure that the hydrophobic membrane 230 is properly sealed and secured to the underside 124 of the top 120. Alternatively, the membrane 230 may be secured to the top 120 via other joining methods including, but not limited to, adhesives, hot melt glue, and laser welding.

As shown in FIG. 5, to maximize the surface area of the hydrophobic membrane 230 and to ensure that the hydrophobic membrane 230 can handle the required flowrate of air in and out of the container 100, the hydrophobic membrane 230 may be sized such that it is substantially larger than the vent opening/hole 160. Additionally, to further maximize the use of membrane material, the hydrophobic membrane 230 may be square.

It should be noted that the top 120 and container body 110 may be formed as two separate pieces and then secured together via ultrasonically welded together. To help facilitate the ultrasonic welding, the top 120 may include a distally extending wall 126 that extends over the top of the container body 110 when the top 120 is placed on the body 110 (e.g., over the proximal end 140 of the body 110). Additionally, on the underside 124, the top 120 may include an energy director 128 to aid in the ultrasonic welding process (e.g., to secure the top 120 to the body 110).

Figure 6:
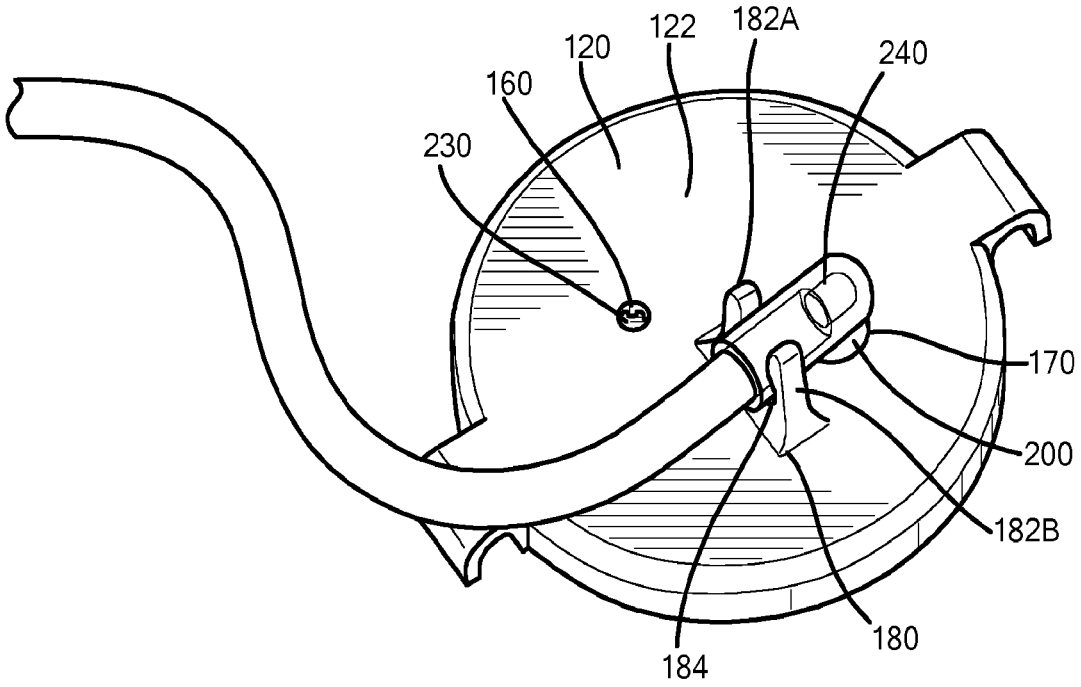
FIG. 6 schematically shows a top perspective view of a top, with a blunt cannula inserted into the septum, for the plasma storage container shown in FIG. 1, in accordance with embodiments of the present invention.
Figure 7:
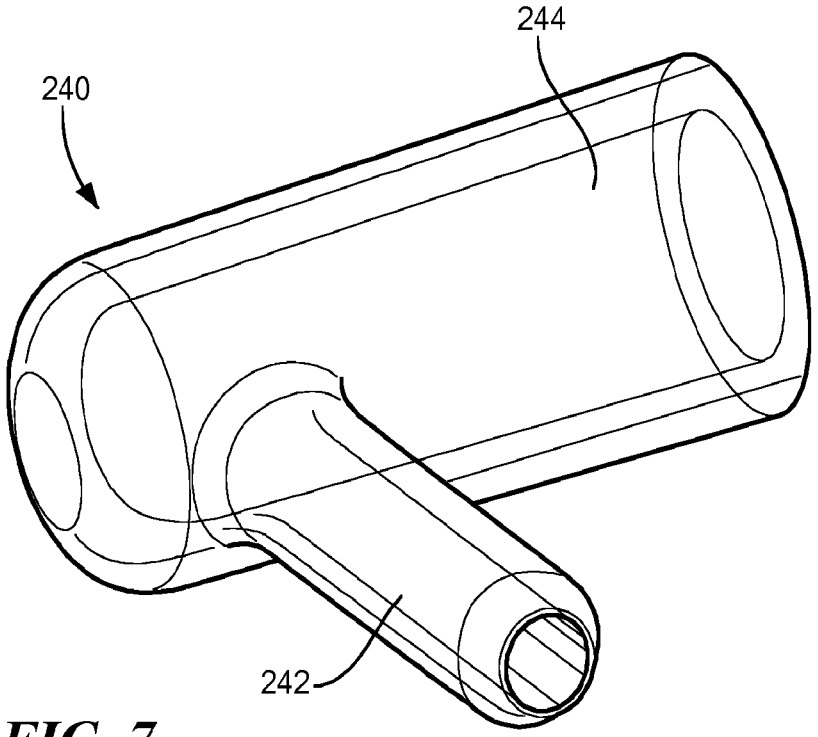
FIG. 7 schematically shows an exemplary blunt cannula for use with the plasma collection container of FIG. 1, in accordance with embodiments of the present invention.
Figure 8:
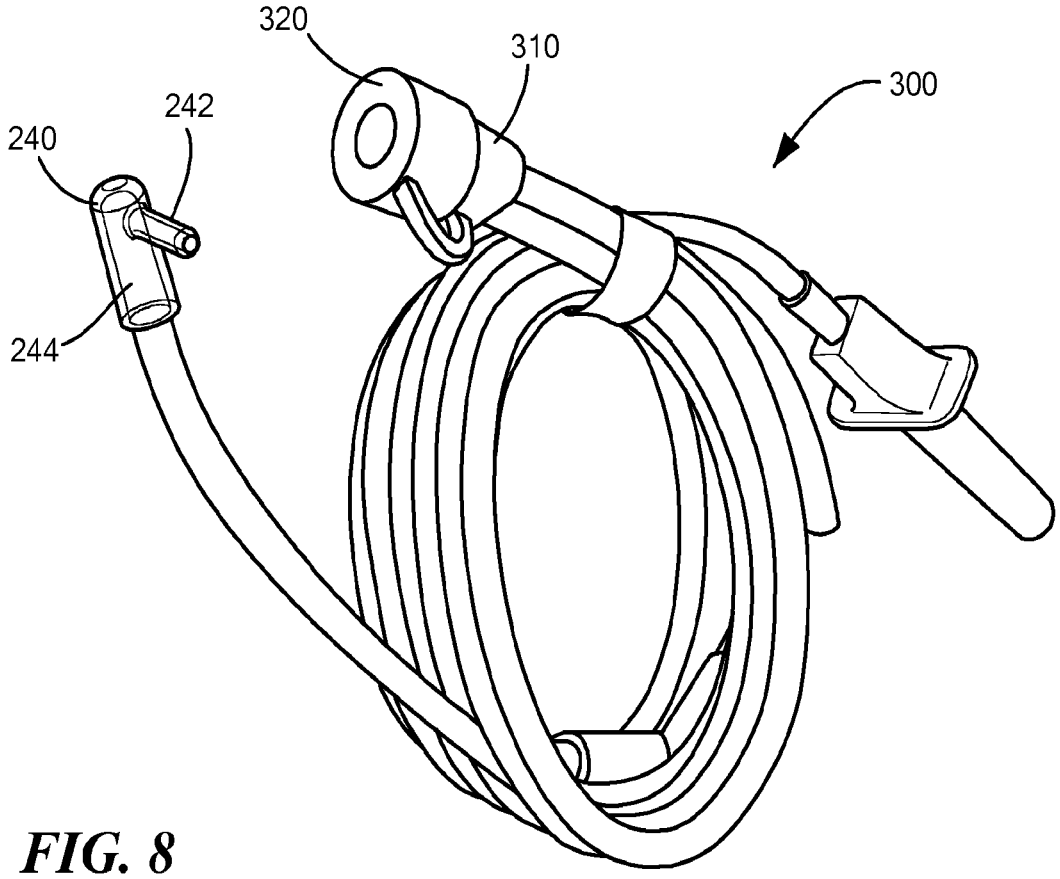
FIG. 8 schematically shows an exemplary tubing set containing the blunt cannula of FIG. 7, in accordance with embodiments of the present invention.
Figure 9:
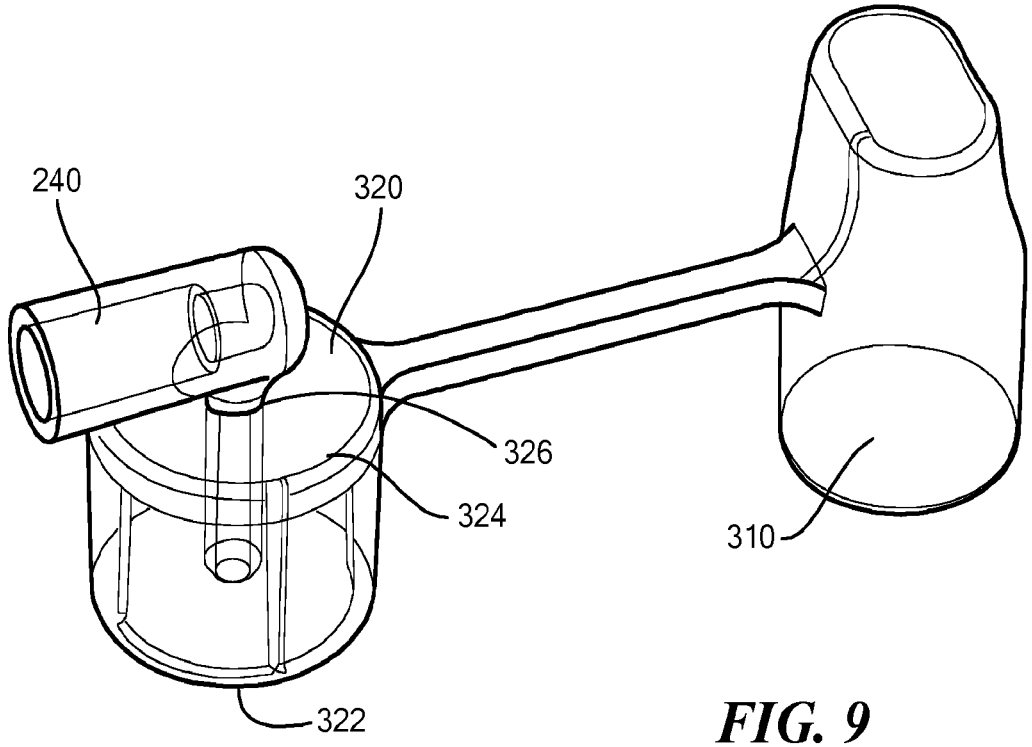
FIG. 9 schematically shows an exemplary cap for the tubing set shown in FIG. 8 with the blunt cannula inserted, in accordance with embodiments of the present invention.

During use and plasma collection, the user may connect the plasma container 100 to a blood processing device via the blunt cannula 240 (FIG. 7) and a tubing set 300 (FIG. 8) on which the blunt cannula 240 may be located. For example, the user may connect the blood processing device connector 310 at one end of the tubing set 300 to the blood processing device (not shown), and the blunt cannula 240 on the other end of the tubing set 300 to the plasma container 100. To connect the blunt cannula 240 to the plasma container 100, the user may insert the outlet portion 242 of the cannula 240 into the septum 200 and through the aperture 220. This will allow the cannula 240 to access the interior volume 150 of the container 100 and create fluid communication between the interior volume 150 and the tubing set 300 (e.g., and the outlet of the blood processing device). The user may then snap the body 244 of the cannula 240 into the retainer 180 to hold the cannula 240 in place on the top 120 (FIG. 6).

As the blood processing device separates the plasma from whole blood and sends the plasma to the storage container 100, the plasma may flow through the tubing set 300 and into the interior volume 150 of the container 100 via the blunt cannula 240. As the plasma flows into the container 100, air will exit the container 100 through the hydrophobic membrane 230 and the vent hole/opening 160. This, in turn, will prevent pressure from building up within the container 100. As needed/required by the blood processing device, air may also enter the container 100 through hydrophobic/sterilizing membrane 230 and the vent hole/opening 160. This, in turn, will prevent vacuum from building up within the container 100.

In order to aid in storage and to ensure that the opening in the outlet portion 242 of the cannula 240 is covered and not exposed to the atmosphere, the tubing set 300 may include a cap 320 that can be used for both the blood processing device connector 310 and the outlet portion 242 of the cannula 240. For example, the cap 320 may have an open end 322 that may be placed over the blood processing device connector 310 when not in use. Additionally, the top 324 of the cap 320 may have an opening 326 in which the outlet portion 242 of the cannula 240 may be inserted. In some embodiments, the cap 320 may be tethered to the blood component device connector 310.

Once the plasma has been collected within the container 100, there may be a need to sample the collected plasma at various times (e.g., after collection, sometime during storage, prior to use). To that end, the user may insert a sample collection container holder (e.g., a vacutainer holder) into the septum 200/aperture 210 to access the volume of plasma within the container 100. The user may then turn the container 100 upside down and connect a vacutainer to the holder to begin collecting a sample of plasma within the vacutainer. It should be noted that collecting the plasma sample in this manner provides the most representative sample of the plasma in the container 100 possible and minimizes/eliminates any loss of plasma, where residual plasma might otherwise be lost in sampling means that involve sampling through tubing external to the top 120.

Although the embodiments described above eliminate both the port for introducing plasma into prior art containers and the port for venting prior art containers (e.g., the ports extending from the plasma container and the sections of tubing connected to the ports, discussed above), some embodiments may eliminate only a single port (e.g., the container may retain one port). For example, some embodiments may utilize the inlet hole 170 and septum 200 but retain the vent port (e.g., a vent port extending from the plasma container and having a section of tubing connected to it). Alternatively, some embodiments may utilize the vent hole 160 and hydrophobic membrane 230 but retain the port to introduce plasma into the bottle (e.g., an inlet port extending from the plasma container and having a section of tubing extending from it).

It should be noted that various embodiments of the present invention provide numerous advantages over prior art plasma storage containers. For example, because embodiments of the present invention eliminate one or more of the plastic stubs and ports mentioned above, some embodiments of the present invention are able to reduce and/or eliminate the risk of breaking and comprising product sterility. Furthermore, various embodiments of the present invention are able to eliminate the need for heat/RF sealing equipment and processes for sealing tubing prior to transportation and storage. Additionally, because embodiments of the present invention allow for sample collection directly via the septum 200 (e.g., as opposed to drawing plasma into a section of tubing first like in many prior art systems), the present invention is able to collect a highly representative sample of the plasma with little/no loss.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A top for a plasma storage container comprising:

a top body defining the structure of the top and configured to seal an opening of the plasma storage container;

a first opening extending through the top body;

a septum located at least partially within the first opening, the septum including an aperture therethrough and configured to allow a blunt cannula or other instrument to pass through the aperture to repeatedly access the interior of the plasma storage container, the septum further configured to seal the first opening when the blunt cannula or other instrument is not connected;

a vent opening extending through the top body; and a hydrophobic membrane located on underside of the top body and covering the vent opening, the hydrophobic membrane configured to allow air to vent through the vent opening during filling of the plasma storage container.

2. A top for a plasma storage container according to claim 1, further comprising:

a skirt extending from the underside of the top body around the first opening, the septum located and secured within the skirt.

3. A top for a plasma storage container according to claim 2, wherein the septum is secured within the skirt via swage connection.

4. A top for a plasma storage container according to claim 3, wherein the skirt and/or the swage connection applies a radially inward force on the septum, the radially inward force keeping the septum secured within the skirt.

5. A top for a plasma storage container according to claim 1, wherein the aperture is closed when the blunt cannula or other instrument is not connected.

6. A top for a plasma storage container according to claim 1, wherein the first opening is larger than the vent opening.

7. A top for a plasma storage container according to claim 1, wherein the top body includes at least one flow channel on an underside of the top body, the at least one flow channel in fluid communication with the vent opening to allow airflow in and out of the plasma storage container via the vent opening.

8. A top for a plasma storage container according to claim 1, wherein a surface area of the hydrophobic membrane is larger than a cross-sectional area of the vent opening.

9. A top for a plasma storage container according to claim 1, wherein the hydrophobic membrane is ultrasonically welded to the underside of the top body.

10. A top for a plasma storage container according to claim 1, wherein the hydrophobic membrane is sealed to the underside of the top body.

11. A top for a plasma storage container according to claim 1, further comprising:

a retainer located on a top surface of the top body, the retainer configured to hold the blunt cannula in place during filling of the plasma storage container.

12. A top for a plasma storage container according to claim 11, wherein the retainer is a clip.

13. A top for a plasma storage container according to claim 1, wherein the other instrument is a sample collection container holder, the septum further configured to allow the sample collection container holder to pass through the aperture to access the interior of the plasma collection container.

14. A top for a plasma storage container according to claim 13, wherein the sample collection container holder is a vacutainer holder.

15. A top for a plasma storage container according to claim 1, wherein the blunt cannula is part of a tubing set connected to a blood processing device.

16. A plasma storage container comprising:

a container body defining the structure of the plasma storage container and defining an interior;

a container top configured to seal an opening of the plasma storage container;

a first opening extending through the container top;

a septum located at least partially within the first opening, the septum including an aperture therethrough and configured to allow a blunt cannula or other instrument to pass through the aperture to repeatedly access the interior of the plasma storage container, the septum further configured to seal the first opening when the blunt cannula or other instrument is not connected;

a vent opening extending through the container top; and a hydrophobic membrane located on underside of the container top and covering the vent opening, the hydrophobic membrane configured to allow air to pass through the vent opening during plasma collection.

17. A plasma storage container according to claim 16, further comprising:

a skirt extending from the underside of the container top around the first opening, the septum located and secured within the skirt.

18. A plasma storage container according to claim 17, wherein the septum is secured within the skirt via swage connection.

19. A plasma storage container according to claim 18, wherein the skirt and/or the swage connection applies a radially inward force on the aperture, the radially inward force biasing the aperture closed.

20. A plasma storage container according to claim 17, wherein the septum is overmolded within the skirt.

21. A plasma storage container according to claim 16, wherein the aperture is closed when the blunt cannula or other instrument is not connected.

22. A plasma storage container according to claim 16, wherein the first opening is larger than the vent opening.

23. A plasma storage container according to claim 16, wherein the container top includes at least one flow channel on an underside of the container top, the at least one flow channel in fluid communication with the vent opening to allow airflow in and out of the plasma storage container via the vent opening.

24. A plasma storage container according to claim 23, wherein a surface area of the hydrophobic membrane is larger than a cross-sectional area of the vent opening.

25. A plasma storage container according to claim 16, wherein the hydrophobic membrane is ultrasonically welded to the underside of the container top.

26. A plasma storage container according to claim 16, wherein the hydrophobic membrane is sealed to the underside of the container top.

27. A plasma storage container according to claim 16, further comprising:

a retainer located on a top surface of the container top, the retainer configured to hold the blunt cannula in place during filling of the plasma storage container.

28. A plasma storage container according to claim 27, wherein the retainer is a clip.

29. A plasma storage container according to claim 16, wherein the other instrument is a sample collection container holder, the septum is further configured to allow the sample collection container holder to pass through the aperture to access the interior of the plasma collection container.

30. A plasma storage container according to claim 29, wherein the sample collection container holder is a vacutainer holder.

31. A plasma storage container according to claim 16, wherein the blunt cannula is part of a tubing set connected to a blood processing device.

32. A top for a plasma storage container comprising:

a top body defining the structure of the top and configured to seal an opening of the plasma storage container;

a first opening extending through the top body;

a septum located at least partially within the first opening, the septum including an aperture therethrough and configured to allow a blunt cannula to pass through the aperture to access the interior of the plasma storage container;

a vent opening extending through the top body;

a hydrophobic membrane located on underside of the top body and covering the vent opening, the hydrophobic membrane configured to allow air to vent through the vent opening during filling of the plasma storage container; and a retainer located on a top surface of the top body, the retainer configured to hold the blunt cannula in place during filling of the plasma storage container and when the blunt cannula is accessing the interior of the plasma storage container.

33. A top for a plasma storage container according to claim 32, further comprising:

a skirt extending from the underside of the top body around the first opening, the septum located and secured within the skirt.

34. A top for a plasma storage container according to claim 33, wherein the septum is secured within the skirt via swage connection.

35. A top for a plasma storage container according to claim 34, wherein the skirt and/or the swage connection applies a radially inward force on the septum, the radially inward force keeping the septum secured within the skirt.

36. A top for a plasma storage container according to claim 32, wherein the aperture is closed when the blunt cannula is not connected.

37. A top for a plasma storage container according to claim 32, wherein the top body includes at least one flow channel on an underside of the top body, the at least one flow channel in fluid communication with the vent opening to allow airflow in and out of the plasma storage container via the vent opening.

38. A top for a plasma storage container according to claim 32, wherein a surface area of the hydrophobic membrane is larger than a cross-sectional area of the vent opening.

39. A top for a plasma storage container according to claim 32, wherein the retainer is a clip.

40. A top for a plasma storage container according to claim 32, wherein the septum is further configured to allow a sample collection container holder to pass through the aperture to access the interior of the plasma collection container.

41. A top for a plasma storage container according to claim 32, wherein the blunt cannula is part of a tubing set connected to a blood processing device.

* * * * *